US005253632A

United States Patent [19]

Brooks

[11] Patent Number: 5,253,632

[45] Date of Patent: Oct. 19, 1993

[54] INTELLIGENT FUEL CONTROL SYSTEM

[75] Inventor: Timothy J. Brooks, Troy, Mich.

[73] Assignee: Ford Motor Company, Dearborn, Mich.

[21] Appl. No.: 992,365

[22] Filed: Dec. 17, 1992

[51] Int. Cl.[5] ..... F02M 51/00

[52] U.S. Cl. ..... 123/696; 123/694

[58] Field of Search ..... 123/696, 694, 675, 492, 123/493, 681, 682

[56] References Cited

U.S. PATENT DOCUMENTS

| | | | |
|---|---|---|---|
| 4,300,505 | 11/1981 | Takada et al. | 123/696 |
| 4,357,923 | 11/1982 | Hideg | 123/492 |
| 4,522,180 | 6/1985 | Matsuoka et al. | 123/696 |
| 4,697,564 | 10/1987 | Ohgami et al. | 123/694 |
| 4,926,826 | 5/1990 | Nakinawa et al. | 123/696 |
| 4,932,383 | 6/1990 | Zechnall et al. | 123/694 |
| 4,932,384 | 6/1990 | Weingartner | 123/696 |
| 5,158,062 | 10/1992 | Chen | 123/674 |

OTHER PUBLICATIONS

D. R. Hamburg et al., "A Closed-Loop A/F Control Model for Internal Combustion Engines," SAE Technical Paper Series, Jun., 1980; (No. 800826).

H. Katashiba et al., "Fuel Injection Control Systems that Improve Three Way Catalyst Conversion Efficiency", SAE Technical Paper Series, Feb., 1991, (No. 910390).

*Primary Examiner*—Raymond A. Nelli

*Attorney, Agent, or Firm*—Allan J. Lippa; Roger L. May

[57] ABSTRACT

An air/fuel mixture control system for an internal combustion engine uses a closed-loop controller which varies the air/fuel mixture in response to the oxygen level in the engine's exhaust emissions to achieve stoichiometry. The oxygen sensor produces a binary signal indicating either a rich or a lean mixture. The controller responds changes in binary sensor signal by delivering fuel at a fixed rate until either (1) the sensor responds by indication an oxygen level change or (2) a predicted transport delay interval expires. In the event the predicted interval expires before the sensor responds, the fixed rate is adjusted in an effort to obtain the desired level change within the allotted interval. In the event the level change is delayed beyond a limit, the predicted transport delay interval is enlarged. If the control system raises the fuel delivery rate above a predetermined rich limit, or below a predetermined lean limit, the base rate from which the initial rates are derived is increased or decreased respectively.

13 Claims, 4 Drawing Sheets

INTELLIGENT FUEL CONTROL SYSTEM

FIELD OF THE INVENTION

This invention relates generally to methods and apparatus for controlling the delivery of fuel to an internal combustion engine, and more particularly, although in its broader aspects not exclusively, to optimizing the amount of fuel delivered to the engine based on past detected performance.

BACKGROUND OF THE INVENTION

Electronic fuel control systems are increasingly being used in internal combustion engines to precisely meter the amount of fuel required for varying engine requirements. Such systems vary the amount of fuel delivered for combustion in response to multiple system inputs including throttle angle and the concentration of oxygen in the exhaust gas produced by combustion of air and fuel.

Electronic fuel control systems operate primarily to maintain the ratio of air and fuel at or near stoichiometry. Electronic fuel control systems operate in a variety of modes depending on engine conditions, such as starting, rapid acceleration, sudden deceleration, and idle. One mode of operation is known as closed-loop control. Under closed-loop control, the amount of fuel delivered is determined primarily by the concentration of oxygen in the exhaust gas, the oxygen concentration being indicative of the ratio of air and fuel that has been ignited.

The oxygen in the exhaust gas is sensed by a Heated Exhaust Gas Oxygen (HEGO) sensor. The electronic fuel control system adjusts the amount of fuel being delivered in response to the output of the HEGO sensor. A sensor output indicating a rich air/fuel mixture (an air/fuel ratio below stoichiometry) will result in a decrease in the amount of fuel being delivered. A sensor output indicating a lean air/fuel mixture (an air/fuel ratio above stoichiometry) will result in an increase in the amount of fuel being delivered.

Modern automotive engines utilize a three-way catalytic converter to reduce the unwanted by-products of combustion. The catalytic converter has a finite number of active sites where the electronic forces are optimum for an electrochemical reaction to take place. The number of active sites limits the mass quantity of reactants that the converter is able to process at any given time.

Maintenance of the ratio of air and fuel at or near stoichiometry is critical to efficient operation of the catalytic converter. In order to affect a maximum conversion efficiency from a three-way catalyst, discrete cyclical quantities of rich and lean exhaust gases must be delivered to the catalyst. Balancing the excursions between rich and lean exhaust gases is important in ensuring that an adequate number of active sites in the converter are available for conversion to take place. A lean air/fuel excursions will oxidize the active sites leaving the ensuing rich excursions to reduce the active sites. In this manner, by alternately processing rich and lean mixtures, the catalytic converter will attain maximum conversion efficiencies. The magnitude and frequency of the rich/lean excursions, however, should never be large enough to saturate the catalyst. A calibration that is either too rich or too lean will cause saturation of the catalyst. The frequency of these excursions will vary with engine operating speed and/or load conditions. Proper control of these necessary excursions increases the efficiency of the converter, thus leading to lower tailpipe emissions.

When altering the air/fuel ratio in response to the detected exhaust gas oxygen content, electronic fuel control systems known in the art respond in a predetermined way to a detected fuel ratio. Consequently, factors such as imprecision in the predetermined response, variation from engine to engine, aging of parts and changes in operating conditions will be unaccounted for, and the performance and efficiency of the engine will suffer accordingly.

SUMMARY OF THE INVENTION

The present invention improves the dynamic response and static performance of an internal combustion engine to obtain higher catalyst conversion efficiencies, lower tail pipe exhaust emissions, and increased engine efficiency.

In a control system contemplated by the invention, the amount of oxygen in the combustion gases generated by the engine is measured by a sensor which produces a rich indication when the oxygen level is low and a lean indication when the oxygen level is high. Each lean indication is responded to by abruptly increasing the fuel delivery rate to an initial rich rate and maintaining that initial rich rate until a rich exhaust indication is obtained or, if no rich indication occurs within a predicted rich step duration, the fuel delivery rate is progressively increased at a predetermined ramping rate above the initial rich rate until a rich exhaust indication is obtained.

Similarly, the control system contemplated by the invention responds to the onset of each rich indication by decreasing the fuel delivery rate to an initial lean rate and thereafter maintains that initial lean rate until a lean exhaust indication is obtained or, if no lean indication occurs prior to the expiration of a predicted lean step duration, the control system progressively decreases the fuel delivery rate still further from the initial lean rate until a lean exhaust indication is produced.

In accordance with a further feature of the invention, the control system adaptively adjusts to varying operating conditions by independently altering the initial rich rate and the initial lean rate whenever the desired oxygen level indication is not obtained within the predicted durations. Thus, whenever a rich exhaust indication is not obtained within the predicted rich step duration, the value of the initial rich fuel flow rate is raised even higher on the next cycle so that the initial rate will be more likely to return the exhaust gases to stoichiometry within the predicted rich step interval.

In accordance with still another feature of the invention, the control system also adaptively alters the predicted duration of the rich and lean step intervals when adjustment of the initial flow rate alone is inadequate. In accordance with this aspect of the invention, the preferred embodiment to be described increases the predicted interval whenever the duration of an actual interval exceeds the predicted interval and the delivery rate has been progressively altered beyond a predetermined limit.

According to still another feature of the invention, the initial rich rate is calculated by forming the sum of a base flow rate and a rich offset value, whereas the initial lean rate is calculated by subtracting a lean offset from the base flow rate. The rich and lean offsets from the base flow rates are independently varied under adaptive control as noted above and, in addition, the initial base flow rate is increased whenever actual flow rate exceeds an upper rich limit, and the initial base flow rate is reduced whenever the actual flow rate is reduced below a lower lean limit.

According to still another feature of the invention, the control system reduces the magnitude and direction of the initial rich rate and the initial lean rate whenever a transition through stoichiometry occurs exactly as predicted. In this way, the control system is able to reduce the magnitude of the excursions about stoichiometry, thereby reducing unwanted emissions.

According to still another feature of the invention, the control system automatically resets itself to predetermined initial states for both rich and lean conditions whenever the controlled rate produces an indication of a premature transition through stoichiometry earlier than predicted. In this way, the control system is able to adapt to unusual circumstances, such as a deviation in fuel type, and to automatically reset itself to initial conditions from which further adaptation may proceed whenever the unusual conditions are discontinued.

These and other features and advantages of the present invention may be better understood by considering the following detailed description of a preferred embodiment of the invention. In the course of this description, reference will frequently be made to the attached drawings.

DETAILED DESCRIPTION

Figure 1:
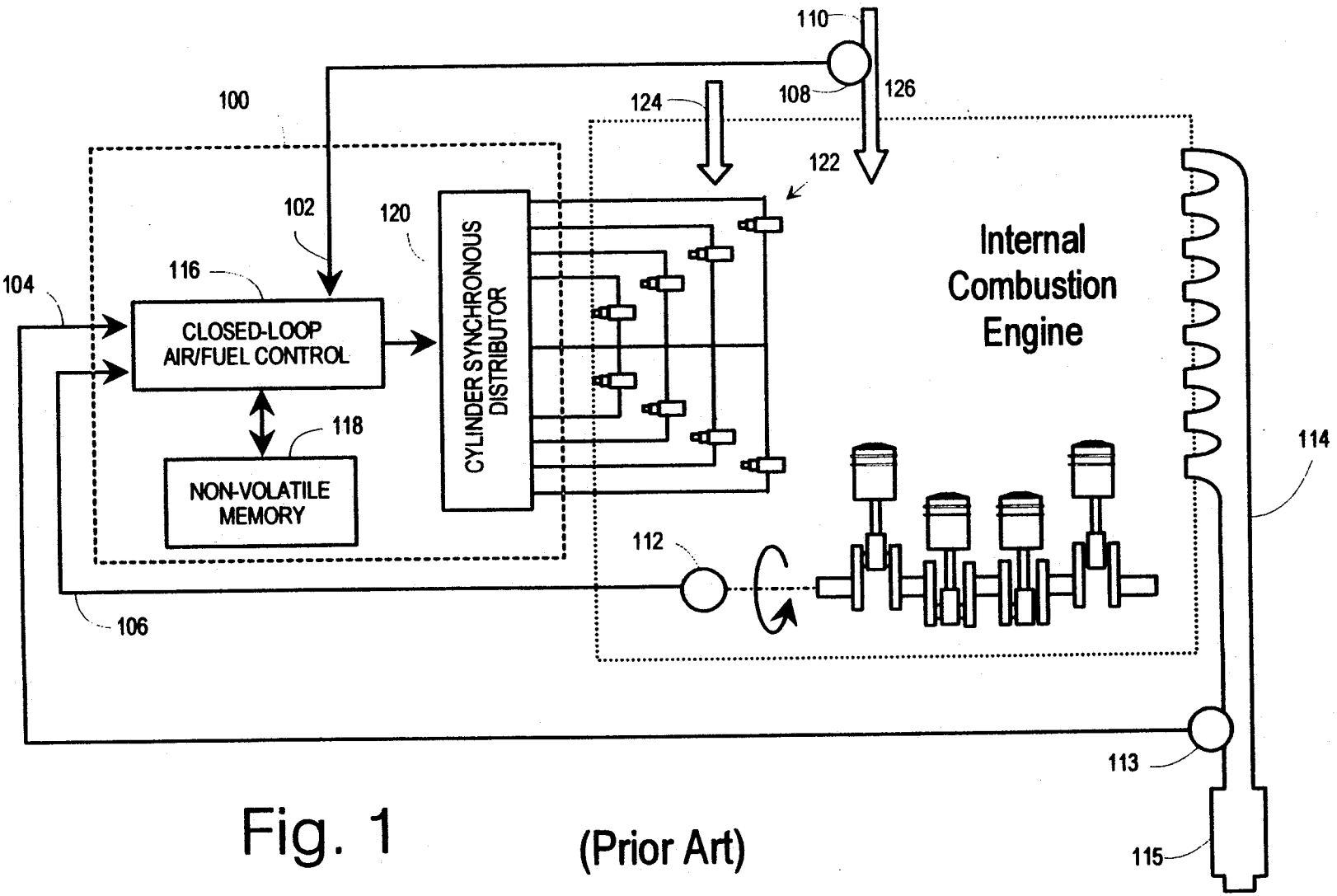
Fig. 1 (Prior Art)
FIG. 1 is a schematic block diagram of an internal combustion engine and an electronic engine control system which embodies the invention.

FIG. 1 of the drawings shows a typical fuel control system of the type which may be adapted to use the principles of the invention. A closed-loop controller 100 has three signal inputs 102, 104, and 106. An air intake manifold vacuum sensor 108 generates a voltage proportional to vacuum strength in an air intake manifold 110. A tachometer 112 generates a voltage proportional to the engine speed. A hot exhaust gas oxygen sensor (HEGO) 113 generates a voltage proportional to the concentration of oxygen in the exhaust manifold 114, and a catalytic converter 115 reduces undesirable by-products of combustion. The oxygen sensor is of a known type typically consisting of a hollow zirconium oxide ($ZrO_2$), shell, the inside of which is exposed to atmosphere.

The controller 100 consists of three modules: a closed-loop air/fuel control processor 116, a nonvolatile memory module 118, and a cylinder synchronous fueling system 120. These modules function together to produce control signals which are applied to actuate fuel injectors indicated generally at 122. Each of the fuel injectors 122, is operatively connected to a fuel pump 124 and physically integrated with an internal combustion engine depicted within the dotted rectangle 126. The fuel injectors 122 are of conventional design and are positioned to inject fuel into their associated cylinder in precise quantities.

These modules are preferably implemented by available integrated circuit microcontroller and memory devices operating under stored program control. Suitable microcontrollers are available from a variety of sources and include the members of the Motorola 6800 family of devices which are described in detail in *Motorola's Microcontroller and Microorocessor Families.* Volume 1 (1988), published by Motorola, Inc., Microcontroller Division, Oak Hill, Texas. The fuel injection signals are timed by processing event signals from one or more sensors (as illustrated by the tachometer 112 in FIG. 1) which may be applied to the microcontroller as interrupt signals. These signals include signals which indicate crankshaft position, commonly called PIPS (Piston InterruPt Signals), which are typically applied to the microprocessor's interrupt terminal (not shown) to execute interrupt handling routines which perform time critical operations under the control of variables stored in memory. By accumulating these interrupt signals, numerical values indicating crankshaft rotation can be made available to the adaptive fuel control system to be discussed.

PRIOR FUEL CONTROL METHODS

Figure 2A:
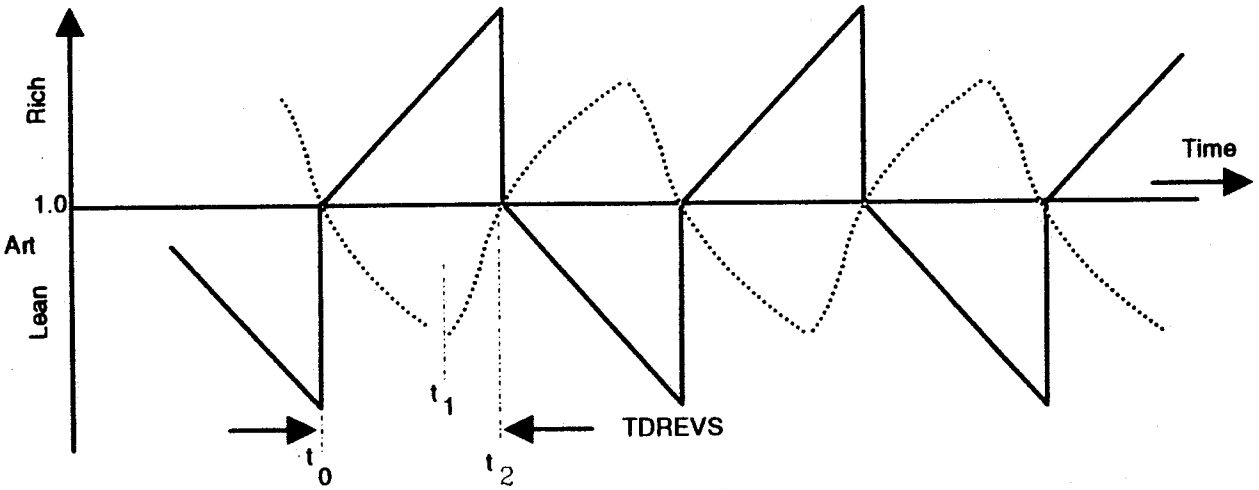
Prior Art Fig. 2(a)
FIGS. 2(*a*) and 2(*b*) are graphs showing the relationship between various signal waveforms in a known fuel control system and an intelligent fuel control system.
Figure 2B:
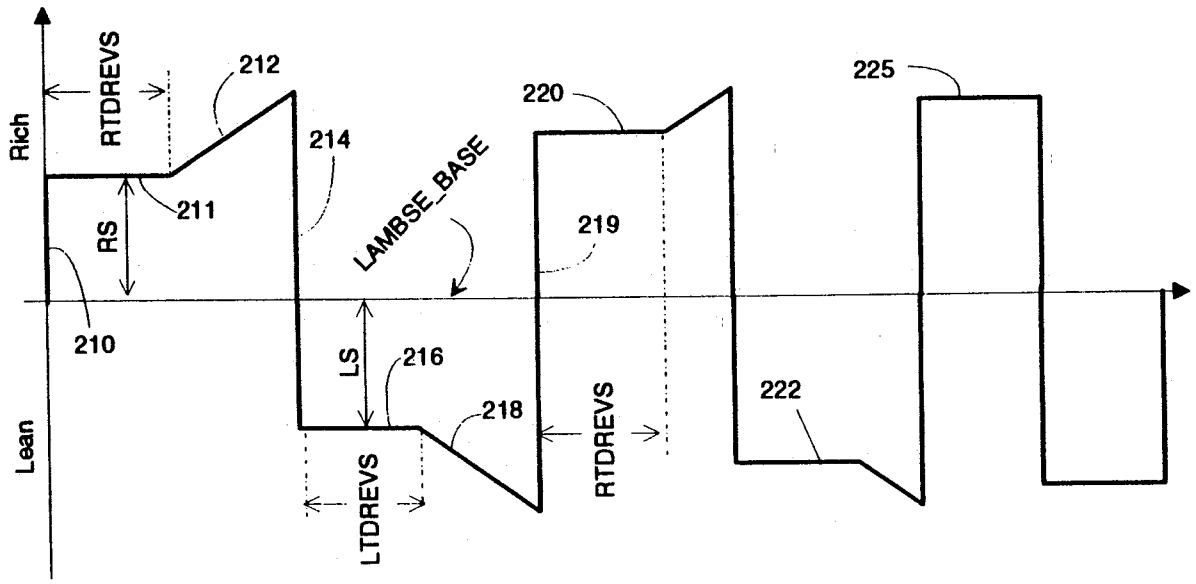

A known method for controlling fuel delivery is illustrated in line (a) of FIG. 2 and was described by D. R. Hamburg and M. A. Schulman in SAE Paper 800826. The controller output signal, shown by the solid line waveshape in line (a), is formed from the sum of an integral, sawtooth component and a term directly proportional to the two-level sensor output signal. The control signal amplitude indicated by the solid-line waveform is proportional to the amount of fuel injected, typically by controlling the pulse width of the injection signals delivered to the injectors 122. The dotted-line waveshape indicates the oxygen level being sensed by the oxygen sensor 113. Each time the exhaust sensor 113 determines that the combustion products indicate stoichiometry, the fuel injectors are commanded to immediately "jump back" to a predetermined nominal air/tuel mixture which is hoped to be at or near stoiohiometry. Thereafter, the flow rate is gradually altered in a direction opposite to its prior direction of change until the exhaust gas sensor determines that stoichiometry has again been reached. The "jumpback" and nominal levels for the control system in line (a) are predetermined and are stored in a nonvolatile memory.

As seen in line (a) of FIG. 2, the peaks of the waveshape illustrating exhaust oxygen level are delayed from the corresponding peaks of the fuel-intake waveshape. This peak-to-peak delay results from the physical transport delays experienced by the air and fuel as it passes through the engine's intake manifold, undergoes combustion in the cylinders, and passes partially through the exhaust system to the position of the sensor. Thus, at time $t_0$, when the exhaust sensor detects a transition from too little oxygen (a "rich" air/fuel ratio) to too much oxygen (a "lean" air/fuel ratio) at the exhaust sensor 113, the previously decreasing fuel flow rate is "jumped back" to a nominal level and then gradually increased. This reversal of the rate of change of the mixture is not manifested at the exhaust sensor until time $t_1$, which is delayed from time $t_0$ by the physical transport delay experienced by the combustion products in passing through the engine and the exhaust system.

The control system illustrated in line (a) of FIG. 2 causes the air/fuel ratio to "hunt" about stoichiometry, and the period of each cycle is delayed considerably beyond the duration of the physical transport delay.

Note that, beginning at time $t_0$ when the effects of the increasing fuel rate are detectable at the sensor, the combustion products seen at the sensor continue to indicate a lean condition until time $t_2$ when the exhaust oxygen level again indicates a rich rather than lean condition. As seen in line (a), by the time $t_2$ when the fuel flow rate is switched to a decreasing slope, the intake mixture has grown excessively rich. The control mechanism depicted in line (a) accordingly allows the intake mixture to deviate substantially from stoichiometry during the prolonged effective closed-loop control delay periods As discussed later, the effective transport delay may be represented numerically by the count of PIPS pulses which occurred as the crankshaft turns between times $t_0$ and $t_2$ to yield the value TDREVS.

The control system illustrated in line (a) fails to account for differences in rich and lean operation. For example, as shown in line (a), if, starting at or near the stoichiometric point, additional fuel is ramped in, at some point along this ramp, the correct amount of fuel will be added such that the oxygen sensor can identify the transition to the rich side of stoichiometry. However, additional fuel continues to be ramped in until the oxygen sensor actually sees the transaction. This additional fuel is unnecessarily added. The same analysis applies to the lean ramping, only in the opposite direction. The peak-to-peak values determine the minimum/maximum excursion of the fuel rate at a set TDREVS. Adding and deleting fuel causes a cyclical variation in engine power. This can result in a driveability parameter called surge if the total excursion is significant. Additionally, the control system in line (a) fails to account for the difference in rich-to-lean versus lean-to-rich TDREVS.

The control system illustrated in line (a) also lacks the capacity to correct for errors or inaccuracies in operation. For instance, if the variations in components from engine to engine, and aging of sensors, fuel injectors and other components produce variations in performance. Such variations consequently require alteration of the fuel control strategy. The system illustrated in line (a) utilizes a fixed control strategy. The strategy is capable of responding only to the current output of the HEGO sensor, and is incapable of correcting for past detected inaccuracies in the delivery of fuel.

The present invention employs a different strategy for controlling the fuel level to more rapidly achieve stoichiometry while preserving the desired repetitive perturbations between rich and lean conditions to improve the conversion efficiency of the catalytic converter. In accordance with the invention, when a shift between the rich and lean levels is detected by the exhaust oxygen sensor, the fuel delivery rate is immediately moved to an initial step value which should be sufficient, without further change, to bring the exhaust mixture back to stoichiometry within a predicted step interval. If stoichiometry is not achieved within the predicted interval, the fuel delivery rate is progressively adjusted during the current cycle to insure that stoichiometry will eventually be achieved. At the same time, the value of the initial step rate to be used on the next cycle is altered to reduce the delay time. If the actual delay in effecting a switch in the HEGO sensor exceeds a predetermined duration, the duration of the predicted interval to be used on the next cycle is increased. Finally, in the event the fuel delivery rate exceeds a predetermined upper rich limit, the average delivery rate is increased by increasing both the initial rich rate and the initial lean rate; whereas, in the event the fuel delivery rate falls below a predetermined lean limit, the initial rich and lean rates are both decreased.

The waveform which appears in FIG. 2(*b*) of the drawings illustrates the manner in which the initial rich and lean rates are adaptively varied as contemplated by the invention. When the oxygen sensor 113 detects a change in operation from rich to lean, the processor 116 commands the fuel system to immediately step to a rich initial rate of delivery as indicated at 210. The initial rich rate is set to the sum of a base value LAMBSE_BASE plus a rich step offset value RS. This initial rich rate is maintained as seen at 211 for a predetermined length of time, designated as RTDREVS (Rich Transport Delay in REVolutionS), which represents the predicted duration of the lean indication from the HEGO sensor. If the HEGO sensor 113 fails to indicate a transition to a rich indication within the predicted lean exhaust interval RTDREVS, the processor 116 then begins to progressively increase the fuel delivery rate as indicated at 212. At 214, when the exhaust sensor indicates that the exhaust oxygen level has been reduced to indicate a rich condition, the processor 116 immediately steps the control waveform to a lean initial step value $LAMBSE_{13}BASE-LS$, where LS is the lean step offset value. At the same time, the processor 116 increases the value of RS so that, on the next cycle, stoichiometry may be more rapidly achieved. This lean fuel output is maintained for a second predetermined length of time, herein designated as LTDREVS (Lean Transport Delay in REVolutionS), as seen at 216. If the exhaust sensor has not indicated a lean condition by the expiration of the LTDREVS interval, the processor 116 begins to progressively reduce the fuel delivery rate even further as seen at 218.

At 219, when the exhaust sensor detects a lean condition, the processor 116 abruptly alters the fuel delivery rate to LAMBSE_BASE+RS; however, since RS was increased on the last cycle, the initial rich rate seen at 220 is higher that the rich rate at 211 on the prior cycle. Also, at 219, since stoichiometry was not reached within LTDREVS at 216, the value of the lean step offset LS is increased so that, at 222, the initial lean rate is reduced below the rate at 216.

As seen at 225, the initial rich rate is increased still further above the prior rate at 220. This rate achieves a switch in the HEGO sensor on schedule and will not be adjusted further unless condition change requiring further adaptation.

As discussed in more detail below, the adaptive control method contemplated by the invention also provides a mechanism for adjusting the duration of the predicted intervals RTDREVS and LTDREVS, for adjusting the value of the base value LAMBSE_BASE, and for resetting the adaptive parameters to initial values when the stoichiometry is achieved before the expiration of a predicted step interval. The adaptive control method also provides a control mechanism for decreasing the magnitude of both the initial rate, RS and LS, and the time for which these rates are maintained, RTDREVS and LTDREVS, if the HEGO sensor switches on schedule. This functionality allows the controller to decrease both the length and magnitude of the excursions about stoichiometry.

CONTROL VARIABLES

Before processing begins, the closed loop control processor 116 first initializes several process variables, including: LAMBSE, RS, LS, INIT_RS, INIT_LS, INIT_RTDREVS, INIT_LTDREVS, LAMBSE_BASE, RST, LST, RTDREVS, LTDREVS, RAMP_RATE, LAMBSE_MAX, and LAMBSE_MIN. RS and LS are variables which represent the rich step and lean step values which operate as positive and negative offsets, respectively, from the base value LAMBSE_BASE. RS and LS are initially set to the values INIT_RS and INIT_LS respectively which are selected based on the predicted performance of the engine. INIT_RTDREVS and INIT_LTDREVS are initial values respectively for RTDREVS and LTDREVS, the predicted rich transit delay and lean transit delay periods respectively.

The initial value for LAMBSE_BASE is set to a nominal value of 1.0. As discussed below, the fuel control signal LAMBSE deviates from LAMBSE_BASE by the offset RS or the offset LS, plus an additional time-varying ramp variation when the offset RS or LS alone is not able to achieve stoichiometry within the predicted duration. LAMBSE is cyclically altered by the closed loop control to vary the air/fuel ratio above and below stoichiometry, with a LAMBSE value of 1.0 corresponding to a desired air/fuel ratio. LAMBSE_BASE is initially set at the value 1.0 and, as will be seen, may thereafter by adaptively varied to correct LAMBSE for variation and aging of parts within the engine.

RST and LST are variables which indicate the times for which respectively the rich step (RS) and lean step (LS) are maintained. RTDREVS and LTDREVS represent the predicted transit time for a switch to a rich and lean flow rate respectively to cause the exhaust oxygen level to reach stoichiometry. For example, when the HEGO sensor indicates the onset of a lean condition, the fuel control processor 116 seen in FIG. 1 responds by switching the LAMBSE signal to an initial rich flow rate (LAMBSE_BASE+RS) which will be maintained for at least the predicted transit delay indicated by RTDREVS.

If the HEGO sensor does not detect a reduction in oxygen level indicating a rich condition within the duration defined by RTDREVS, then the LAMBSE value is increased even further at a rate determined by RAMP_RATE. Similarly, the processor 116 has reduced the fuel delivery rate (to LAMBSE_BASE−LS) for a duration which exceeds LTDREVS, LAMBSE is decreased even further at RAMP_RATE until the sensor responds by detecting a lean condition.

Whenever stoichiometry is reached in an interval that exceeds the predicted interval RTDREVS, the actual duration RST is compared with a threshold value RSTMAX. If the duration RST was not excessive, the value of RTDREVS is increased whereas, if RST was greater than RSTMAX then the value of RS is increased. The control variables LTDREVS and LST are adaptively varied in the same way in response to excessive excursions of the value LST beyond LTDREVS and LSTMAX.

The optimum values of the adaptive variables RS, LS, RTDREVS, and LTDREVS, as well as the parameters RSTMAX, LSTMAX, and RAMP_RATE, differs substantially at different engine speeds and loads. Accordingly, these variables are preferably stored in a lookup table indexed by speed and load variables. Although these values are referred to in this specification as if they were single values, it should be understood that each such value is advantageously selected from a two-dimensional array of values indexed by the combination of a numerical speed value (obtained from sensor 112 via input 106 seen in FIG. 1) and a numerical engine load value (obtained from sensor 108 via input line 102). These indexed lookup tables are preferably implemented using a portion of the non-volatile memory (KAM or "Keep Alive Memory") which retains the adaptively learned values when the engine is turned off.

Whenever the LAMBSE signal makes an excursion outside a predetermined acceptable range, bounded by an upper limit LAMBSE_MAX and a lower limit LAMBSE_MIN, the base value LAMBSE BASE is modified in the same direction to effectively shift the average value of the LAMBSE value toward rich, or toward lean, as required to more rapidly achieve stoichiometry. In this way, the adaptive control compensates for conditions, such as changing fuel types, which may require a change in the average air/fuel ratio for best performance.

PROCESSING

Figure 3:
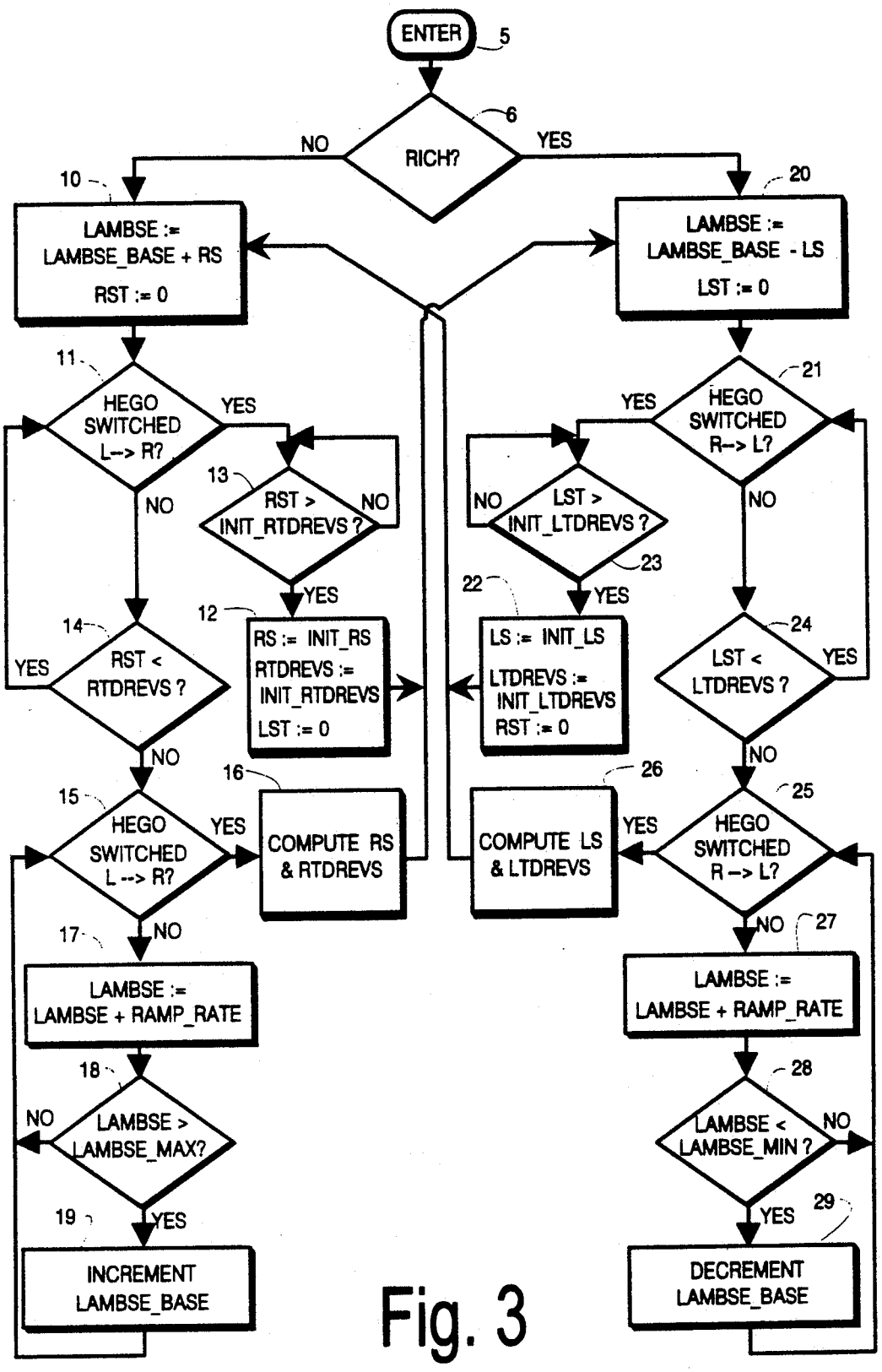
FIGS. 3, 4*a* and 4*b* are flowcharts depicting the operation of a preferred embodiment of the invention.

The flowcharts seen in FIGS. 3, 4(*a*) and 4(*b*) illustrate the details of a preferred method for implementing the functionality described above by means of a control processor of the type indicated at 116 in FIG. 1. After initialization, previously described, a closed-loop fuel control algorithm is repetitively executed as indicated in FIG. 3.

As noted earlier, the concentration of oxygen in the exhaust gas is detected by the hot exhaust gas oxygen (HEGO) sensor 113, which may be the zirconium oxide ($ZrO_2$) type well known in the art. The HEGO sensor 113 generates a voltage proportional to the concentration of oxygen in the exhaust manifold 114 which may advantageously be converted into a digital quantity by an analog-to-digital converter within the microcontroller used to implement the control. The oxygen level value is compared to a predetermined threshold value which, for the particular HEGO sensor used, represents the sensor voltage output at stoichiometry. This comparison produces a two-state (rich or lean) value HEGO which is tested at blocks 6, 11, 15, 21, and 25 in FIG. 3 as described below.

If the HEGO value test at 6 indicates excess oxygen and a lean mixture, LAMBSE is set to RS+LAMBSE_BASE at 10 and RST is initialized to zero. If the value indicates a rich exhaust mixture (i.e., insufficient oxygen), LAMBSE is set to LS−LAMBSE_BASE at 20 and LST is initialized to zero. The controller's method of responding to either a rich or a lean mixture is similar, as plainly seen by the symmetry between lean condition processing at the left and rich condition processing at the right in FIG. 3. Accordingly, the operation of the system's response to a lean mixture will be described in the text that follows with the understanding that the method for responding to a rich mixture is essentially the same.

Once LAMBSE is set at 10, to the base value LAMBSE_BASE plus the rich step RS offset, the controller 100 enters a loop including the tests 11 and 14. The HEGO value is checked at 11 to see if it has switched to indicate a rich exhaust. If it has not, then RST (the Rich Step Time elapsed since the rich input flow began) is checked against the predicted time RTDREVS at 14. If RTDREVS has not elapsed then the loop is re-executed. Note that the variable RST is continually incremented by the engine rotation signals received via line 106 as the crankshaft rotates to provide an increasing value which reflects the amount of crankshaft rotation which has occurred since the rich step began.

If the HEGO value switches prematurely, before RST reaches RTDREVS as detected at 11, then the controller checks at 13 to see if RST has reached INIT_RTDREVS, the initial value of RTDREVS. If not then the controller loops back to the test at 9 until an INIT_RTDREVS time period has elapsed. By maintaining RS for at least INIT_RTDREVS the controller ignores premature switches in the HEGO sensor which may be representative of the exhaust output of a single cylinder which has either ignited an inaccurate air/fuel mixture or has ignited prematurely.

Once RS has been maintained for INIT_RTDREVS, then the initial rich step offset value RS is reset to its initial value INIT_RS, RTDREVS is reset to its initial value INIT_RTDREVS, and the controller enters the lean condition processing by setting the fuel flow rate lean (at LAMBSE_BASE−LS) as indicated at 20. Thus, the adaptive variables RS and RTDREVS which are initialized at the fixed values INIT_RS and INIT_RTDREVS when system operation begins, are allowed to adaptively increase or decrease as needed to match actual operating conditions. Learning the adaptive parameters in this fashion helps to insure a balanced variation of LAMBSE about stoichiometry and thus enhances operation of the catalytic converter by balancing the number of active sites in the converter on which catalytic conversion takes place for rich and lean operation.

Once the predicted interval (crankshaft rotation RTDREVS) has been detected, a further loop is entered and a test performed at 15 to determine if the HEGO value indicates a rich exhaust mixture. When it does, then a new value for the initial rich step RS and the predicted rich transit delay RTDREVS is computed at 16 (as described in more detail below in connection with FIG. 4(*a*)), and the controller then switches to a lean mode of operation at 20.

If the HEGO value checked at 15 is still lean, the controller concludes that extra fuel is required to effect a switch. Thus, at 17, LAMBSE is incremented by the variable RAMP_RATE. At 18, LAMBSE is checked against LAMBSE_MAX, and if LAMBSE is not greater than LAMBSE_MAX then the HEGO sensor is again checked at 15 to continue the loop.

If LAMBSE>LAMBSE_MAX at 18, then LAMBSE_BASE is incremented at 19, and the controller returns to 15. Thus, whenever LAMBSE increases to a level above LAMBSE_MAX, the base value LAMBSE_BASE is increased upwardly such that, on the next cycle, the initial rich value LAMBSE_BASE+RS established at 10 will be increased while the initial lean value LAMBSE_BASE−LS established at 20 will also be increased (less lean).

The loop comprising the functions indicated at 15, 17, 18 and 19 is executed until the HEGO value switches from a lean to rich indication. During this time, after RST passes RTDREVS, LAMBSE is increased at a constant rate, the RAMP_RATE, until a switch from lean to rich operation is indicated. Once this occurs, new values for RS and RTDREVS are calculated at 16 and the controller enters the lean mode of operation.

Figure 4B:
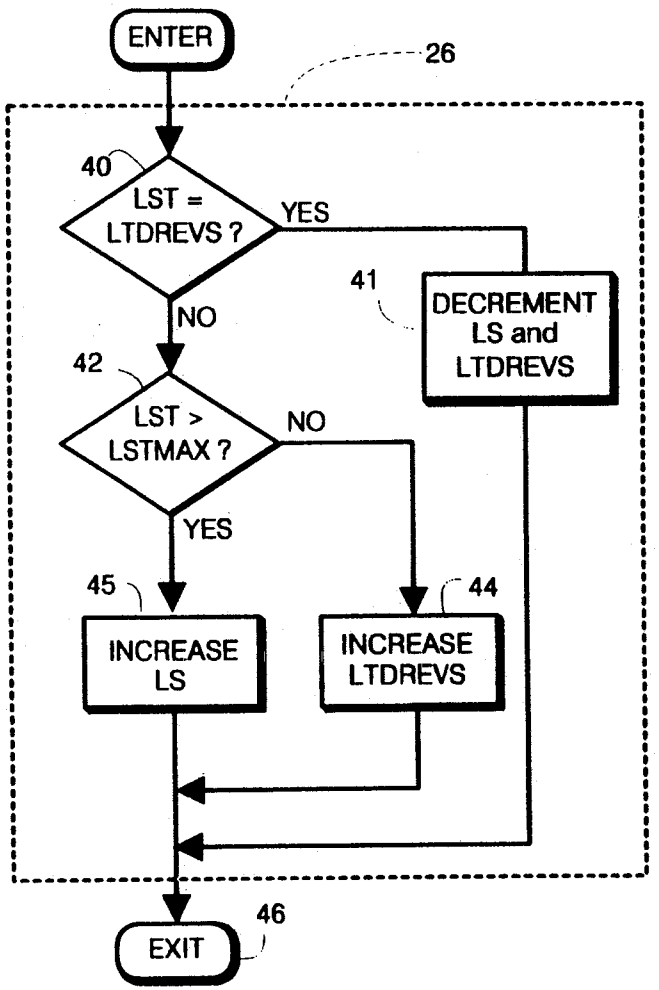
Figure 4A:
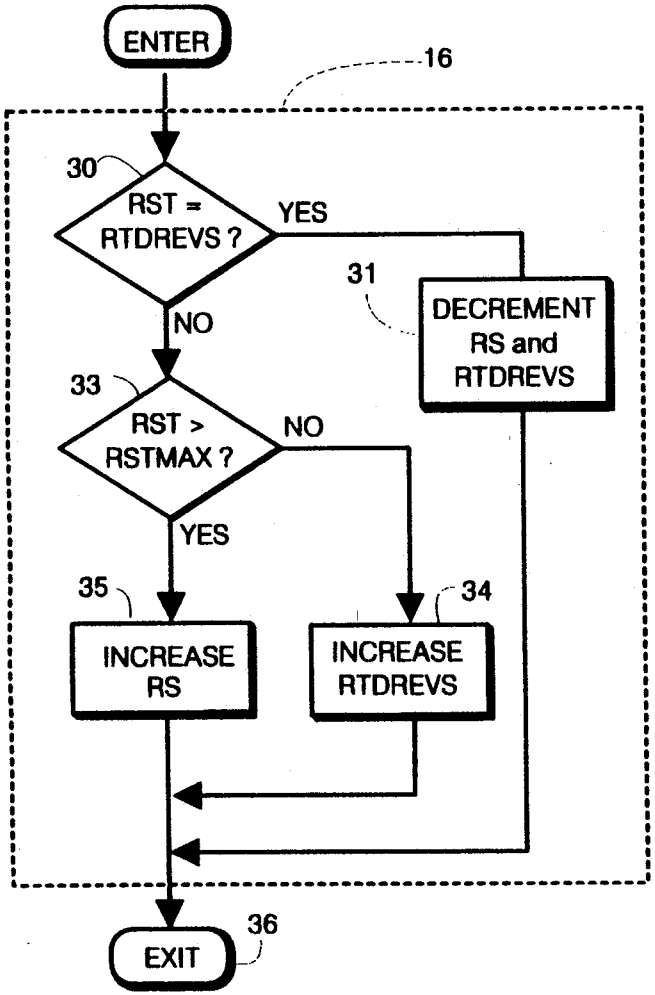

The calculation of RS and RTDREVS is depicted in greater detail in FIG. 4*a*. FIG. 4*b* shows the similar steps for the calculation of LS and LTDREVS. RST is compared against RTDREVS at 30. If RST matches RTDREVS or falls within a certain narrow range, indicating that the switch from lean to rich occurred on schedule as predicted by RTDREVS, then both RS and RTDREVS are decremented by a constant and the routine is exited at 36. In this manner, the controller attempts to minimize the magnitude and length of the excursions from stoichiometry.

If RST did not exceed a time period greater than a threshold value RSTMAX then the controller increments RTDREVS and RS is left unchanged. RSTMAX is preferably equal to 2 * RTDREVS. As noted above, RTDREVS represents a transit delay from a change in the air/fuel ratio to the detection of the change by the HEGO sensor. If RST has exceeded RTDREVS and the controller has started to ramp the fuel rich, then this increased fuel delivery rate will not be seen at the HEGO sensor until an RTDREVS period later. If the HEGO sensor switches less than one RTDREVS period after ramping has begun, i.e. RTDREVS<RST<RSTMAX, then the controller concludes that only an incremental change in the fuel delivery strategy is needed to effect a HEGO switch at the desired time. Consequently, RTDREVS is incremented at 34. If RST>RSTMAX then the controller concludes that the ramping which started at RST=RTDREVS was required to effect a switch in the HEGO sensor. Consequently, RS is increased at 35. At 34, RS may be simply incremented by a fixed amount, or may be incremented by an amount proportional to the excess delay experienced: RS :=RS 30 ($K_s$* (RST−RTDREVS)) where $K_S$ is a constant selected to yield an appropriate adaptive rate of change for the initial step size. Similarly, at 34, RTDREVS may be simply incremented or may be altered the relation: RTDREVS :=RTDREVS+($K_i$* (RST - RTDREVS)) where $K_i$ is a constant selected to yield an appropriate adaptive rate of change for the predicted transit interval. Both $K_S$ and $K_S$ are advantageously selected to increase RS and RTDREVS respectively, by a sufficient amount to ensure that the controller does not need to calculate a new value on every step, thus reducing the amount of calculation performed by the processor 116.

The flowchart of FIG. 4(*b*) shows the routine 26 for calculating new values for the adaptive variables LS and LTDREVS whenever the measured delay LST exceeds the predicted lean transport delay LTDREVS.

It is to be understood that the specific mechanisms and techniques which have been described are merely illustrative of on application of the principles of the invention. Numerous modifications may be made to the methods and apparatus described without departing from the true spirit and scope of the invention.

What is claimed is:

1. The method of controlling the fuel delivery rate at which fuel is supplied to the fuel intake of an internal combustion engine comprising, in combination, the steps of:

measuring the amount of oxygen in the combustion gases exhausted by said engine to produce a rich exhaust indication when said oxygen level is low and a lean exhaust indication when said oxygen level is high;

responding to the onset of each lean exhaust indication by abruptly increasing said fuel delivery rate to a predetermined rich step value thereafter maintaining said delivery rate at said rich step value until the onset of a rich exhaust indication or until a predetermined rich step duration expires;

responding to the expiration of said rich step duration by progressively increasing said delivery rate from said predetermined rich step value until a rich exhaust indication is produced;

responding to the onset of each rich exhaust indication by abruptly decreasing said fuel delivery rate to a predetermined lean step value and thereafter maintaining said delivery rate at said lean step value until the onset of a lean exhaust indication or until a predetermined lean step duration expires; and responding to the expiration of said lean step duration by progressively decreasing said delivery rate from said predetermined lean step value until a lean exhaust indication is produced.

2. The method set forth in claim 1 comprising the further step of increasing said rich step value whenever the duration of a lean indication exceeds a first interval.

3. The method as set forth in claim 2 comprising the further step of increasing said lean step value whenever the duration of said rich indication exceeds a second interval.

4. The method set forth in claim 3 further comprising the step of increasing the duration of said first interval whenever the duration of said lean indication exceeds a first duration limit.

5. The method set forth in claim 4 further comprising the step of increasing the duration of said second interval whenever the duration of said rich indication exceeds a second duration limit.

6. The method as set forth in claim 4 wherein said first interval is substantially equal to two times said first duration limit.

7. The method as set forth in claim 5 wherein said second interval is substantially equal to two times said second duration limit.

8. The method as set forth in claim 1 comprising the additional steps of:

producing a base value, producing said rich step value by adding said base value to a rich offset value, producing said lean step value by subtracting a lean offset value from said base value, increasing said base value whenever said fuel delivery rate exceeds a predetermined rich rate limit, and decreasing said base value whenever said fuel delivery rate falls below a predetermined lean rate limit.

9. In combination, a fuel intake system which responds to a fuel control signal for varying the rate at which fuel is delivered to an internal combustion engine, a sensor positioned to sense the amount of oxygen in the combustion products exhausted by said engine, means coupled to said sensor for producing lean and rich exhaust indications when said amount of oxygen is respectively above or below a value representing stoichiometry, and control signal generating means coupled to said fuel intake system and responsive to said lean and rich exhaust indications for altering said fuel delivery rate, said signal generating means comprising, in combination, means responsive to the onset of a lean indication for establishing an initial rich rate which continues until the onset of a rich exhaust indication or until a predicted rich rate interval expires, means responsive to the expiration of said predicted rich rate interval for progressively increasing said rate until the onset of a rich exhaust indication, means responsive to the onset of a rich indication for establishing an initial lean rate which continues until the onset of a lean indication or until a predicted lean rate interval expires, and means responsive to the expiration of said predicted lean rate interval for progressively decreasing said rate until the onset of a lean indication.

10. The combination set forth in claim 9 wherein said control signal generating means further comprises, in combination, means responsive to the persistence of a rich indication for a duration in excess of a first limit for increasing said initial lean rate, and means responsive to the persistence of a lean indication for a duration in excess of a second limit for increasing said initial rich rate.

11. The combination set forth in claim 10 wherein said control signal generating means further comprises, in combination, means responsive to the expiration of said lean rate interval for increasing the duration of said lean rate interval, and means responsive to the expiration of said rich rate interval for increasing the duration of said rich rate interval.

12. The combination set forth in claim 11 wherein said first limit is substantially equal to two times said lean rate interval, and said second limit is substantially equal to two times said rich rate interval.

13. The combination set forth in claim 9 wherein said control signal generating means further comprises a memory for storing plural values, means for detecting the rotational speed of said engine to produce a speed signal, means for determining the air intake rate into said engine to develop a load signal, and means responsive to the magnitude of said speed and load signals for selecting said initial rich rate, said initial lean rate, said rich rate interval, and said lean rate interval.

* * * * *